United States Patent [19]

Kottke

[11] Patent Number: 4,538,440

[45] Date of Patent: Sep. 3, 1985

[54] ROLL SWAGE DEVICE

[75] Inventor: Louis E. Kottke, Adrian, Mich.

[73] Assignee: Acco Babcock Inc., Trumbull, Conn.

[21] Appl. No.: 633,084

[22] Filed: Jul. 24, 1984

Related U.S. Application Data

[63] Continuation of Ser. No. 396,308, Jul. 8, 1982, abandoned.

[51] Int. Cl.[3] ..... B21D 19/10

[52] U.S. Cl. ..... 72/189; 72/213

[58] Field of Search ..... 72/189, 197, 212, 213, 72/194; 140/111, 113; 29/508, 517

[56] References Cited

U.S. PATENT DOCUMENTS

| | | | |
|---|---|---|---|
| 265,057 | 9/1882 | Garnar . | |
| 685,417 | 10/1901 | Williams . | |
| 840,426 | 1/1907 | Briede . | |
| 1,549,527 | 8/1925 | Fielding . | |
| 1,625,340 | 4/1927 | Thomas | 72/189 |
| 1,912,751 | 6/1933 | Batcheller . | |
| 2,248,147 | 7/1941 | Wilson | 72/189 |
| 2,311,662 | 2/1943 | Hunziker | 29/508 |
| 2,979,085 | 4/1961 | Rogge | 72/189 |
| 3,396,570 | 8/1968 | McCardell . | |
| 4,100,785 | 7/1978 | Bishop | 72/213 |

*Primary Examiner*—Lowell A. Larson

*Attorney, Agent, or Firm*—Pennie & Edmonds

[57] ABSTRACT

Device for swaging a loose fitting onto a core. The device has at least two opposed coplaner swaging tools each rotatable about a fixed axis and together forming a swaging station. Pusher means are provided for pushing the fitting through the swaging station while at the same time rotating the tools about their axes.

4 Claims, 7 Drawing Figures

ROLL SWAGE DEVICE

This is a continuation of application Ser. No. 396,308, filed July 8, 1982, now abandonded.

TECHNICAL FIELD

This invention relates to a roll swage device and more particulary to a device for swaging a loose sleeve-like fitting onto a core where the device has at least two opposed coplanar swaging tools each rotatable about a fixed axis to form a swaging station and means for pushing the fitting through the swaging station.

BACKGROUND OF THE INVENTION

Swaging devices have been proposed for swaging articles where the device has a plurality of forming dies surrounding the article to be formed and where the forming action results from an impact of the dies onto the article. The total energy required in moving the dies so that they impact onto the article with sufficient force necessary to deform it are considerable and die wear in such a device is excessive. Further it is difficult in many of the devices to adapt them for automatic feed of the articles where they are, for example, to be joined onto other articles such as sleeve-like fittings being joined onto cores.

It has been proposed in an effort to reduce the forces acting on the dies to taper the surfaces of the die engaging the article to be deformed so that the die engages the article gradually. Even so, energy required to move the dies is considerable.

It is therefore an object of my invention to provide for a swaging device in which tool or die wear is reduced, which requires a minimum of energy necessary to move the dies so that they will deform an article, and which may be easily adapted for automatic feed of articles to be formed to the device.

GENERAL DESCRIPTION OF THE INVENTION

Broadly a swage device constructed according to my invention has at least two opposed coplanar swaging tools positioned to form a swaging station and where each tool is mounted for rotation about a fixed axis. Pusher means are provided whereby the article or fitting to be swaged is pushed towards the swaging station so that the swaging tools contact the article at an entry side of the station. Continued movement of the pusher means forces the article completely through the swaging station while at the same time each tool is rotated about its fixed axis such that it crimps the fitting. Continued movement of the pusher means then results in the fitting being ejected from the swaging station at an exit side of the station. Return means are provided for rotating the tools about their fixed axes to a point where they may again be engaged by a fitting.

Preferably the pusher means comprises in part a piston slidable in a hydraulic cylinder or a mechanically movable member and the return means comprises a tension spring operatively connecting each swaging tool and the piston or mechanically movable member to urge the tool in a direction towards the entry side of the swaging station. Further prefereably a cavity or socket-like member is operatively connected to the piston and is adapted to surround and engage the fitting. A pusher finger is also preferably operatively positioned between the piston or mechanically movable member and each said tool to provide a driving force for rotating the tools about their axes. Retaining means are provided for holding each finger into contact with a tool.

In one form of the invention and in order to provide a maximum driving force to move the fitting through the swaging station, the cavity or socket-like member is connected directly to the piston to provide a positive drive connection between the piston and cavity member. Each pusher finger is longitudinally fixed with respect to its associated swaging tool and positioned to provide a direct drive connection between the two.

In a further form of the invention a spring means is operatively interposed between the piston and cavity member while the pusher fingers remain longitudinally fixed with respect to the piston and the swaging tools. This form of the invention allows for relative movement between the fitting and forming faces of the swaging tool and compensates for the slight difference in relative surface speed between the fitting and swaging tool that occurs due to a slight change in radius of the forming face of each tool as it rotates about its axis. Unless compensated, this difference in speed can result in the fitting being slightly pulled away from the cavity member which in turn can lead to concentricity problems with the fitting.

In a still further form of the invention the driving connection between the cavity member and piston remains a direct drive connection while spring means are operatively interposed between the individual pusher fingers and piston. This provides for relative movement between the forming faces of the swaging tool and the fitting in the same manner as in the previously described embodiment in order that the fitting will not be pulled away from the cavity member.

DESCRIPTION OF THE PREFERRED EMBODIMENTS

Figure 1:
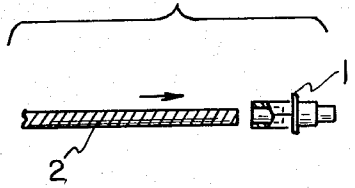
FIG. 1 is a partial sectional exploded view of a fitting prior to being swaged onto a core.
Figure 4:
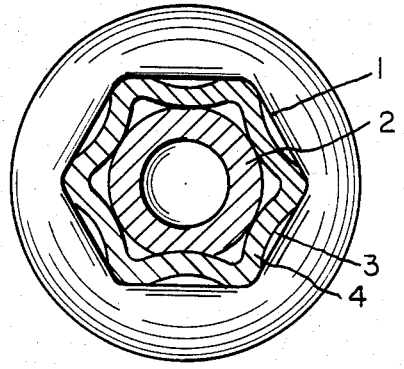
FIG. 4 is an enlarged sectional end view of the fitting of FIG. 1 swaged onto a core.

Referring to FIG. 1, there is illustrated a sleeve-like fitting 1 which is to be swaged onto a core 2. In the form shown the fitting comprises a conduit termination member while the core comprises a flat wire metal conduit and which both together form a conduit assembly. The termination member as shown in FIGS. 1 and 4 has a hexagonal sided configuration with each side or face 3 being swaged or crimped inwardly at point 4 so that the fitting is fixed tightly to the conduit.

Figure 2:
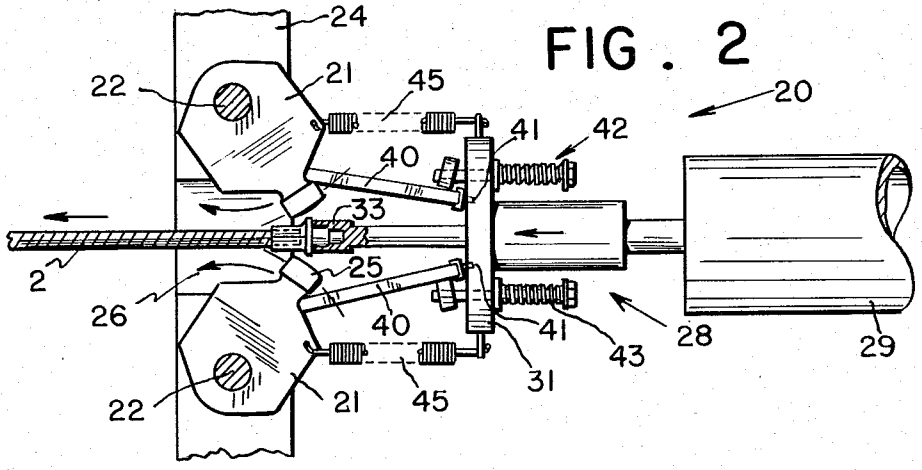
FIG. 2 is a partial sectional side view of a swaging device constructed according to the invention with the fitting at the entry side of the swaging station of the device.
Figure 5:
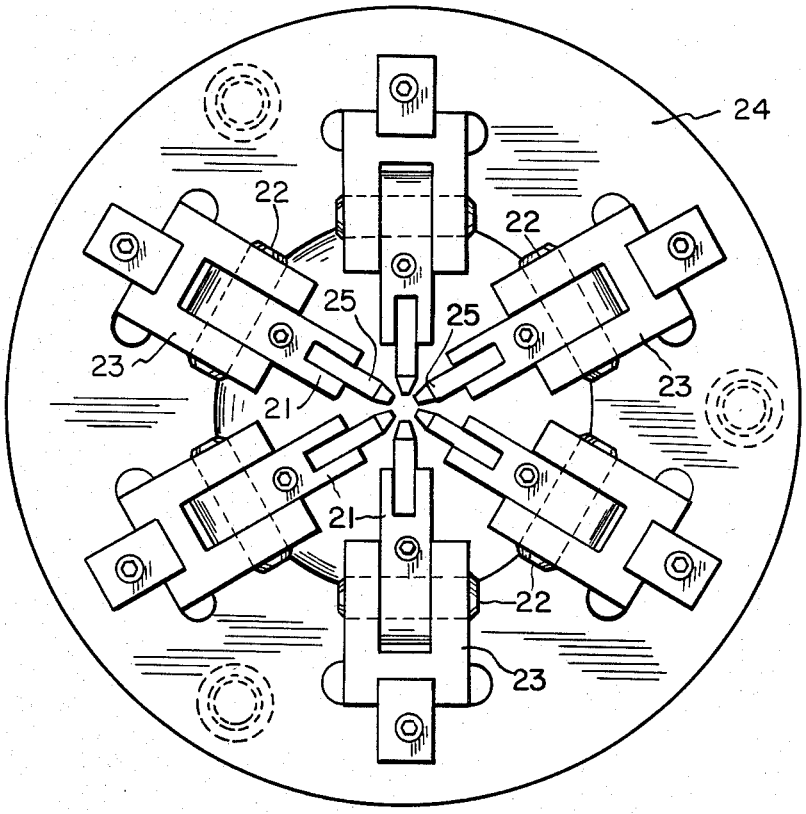
FIG. 5 is an end view of the swaging device of FIG. 4 looking towards the exit side of the swaging station.

Referring to FIGS. 2 and 5 the swage device 20 of the invention comprises a plurality of swaging tools 21 each mounted for rotation about a pin 22 carried in a roller block 23 which in turn is mounted on frame member 24 of the swage device. The axis of each pin 22 is fixed with respect to the swage device.

The swage tools of which there are six in number are opposed to each other and extend in a single plane perpendicular to the longitudinal axis of the swage device. While six such tools are disclosed, the device could have more than six and as few as three. Each tool 21 has a forming face 25 which in cross section may have any desired configuration and which in a side view may have any desired profile depending on the desired configuration of the fitting after swaging. As shown in FIG. 2, the profile of the forming face forms an arc of a circle and as shown in FIG. 5, the cross section of the forming face forms part of a trapezoid.

The swaging tools together form a swaging station 26 having an entry side to the right of a plane containing the fixed axes of the pins 22 as shown in FIG. 2 and an exit side to the left of the plane.

A pusher means 28 comprising a piston (not shown) slidable in hydraulic cylinder 29 is connected by rod 30 to a plate 31. Plate 31 has an extension 32 thereon on which a cavity or socket-like member 33 is carried and which forms a socket to receive and engage an axial end of the fitting 1 to provide a positive drive connection between the piston and the fitting. Movement of the piston rod 30 in the direction of the arrows drives the cavity member 33 to the left to force the fitting from the entry side of the swaging station through the station and then out of the station.

A pusher finger 40 is positioned between each swaging tool and plate 31 to comprise a positive drive connection between the pusher means 28 and each tool to provide the driving force to rotate the tool in a direction towards the swaging station as shown in FIG. 2. Each finger is pivotally connected at its end 41 to the plate in order that the finger may pivot with respect to the plate as its associated tool rotates about its fixed axis.

Retainer means 42 in the form of a compression spring hold the pivotal end 41 of each finger into contact with the plate 31.

A return spring 45 connects each tool 21 with the plate 30 and urges each tool to rotate in a direction back towards the entry side of the forming station after a fitting has been swaged onto a core and to a position to again initially contact a fitting.

The operation of the device is as follows: A conduit 2 having a fitting loosely applied on the end is moved to the right with reference to FIG. 2 through the swaging station 26 until the fitting 1 seats within cavity member 33. At this point the hydraulic cylinder is pressurized to move the pusher means to the left in the direction of the arrows. Continued movement causes the fitting to move to the left and at the same time the fingers 40 rotate the tools and forming faces 25 towards the swaging station. As the faces 25 initially contact the fitting at the entry side of the swaging station, continued movement of the fitting and swaging tool causes a rolling action driving the fitting between the forming faces resulting in a knuckling through the center of all the swaging tools to crimp or swage the fitting onto the conduit or core 2. Continued movement of the pusher means pushes the fitting out of the swaging station to the position shown in FIG. 3 at which point the fitting is removed from the cavity member 33. The pusher means is returned to its starting position and tension or return springs 45 rotate the swage tools back to their starting position where the cycle may then be repeated.

Figure 3:
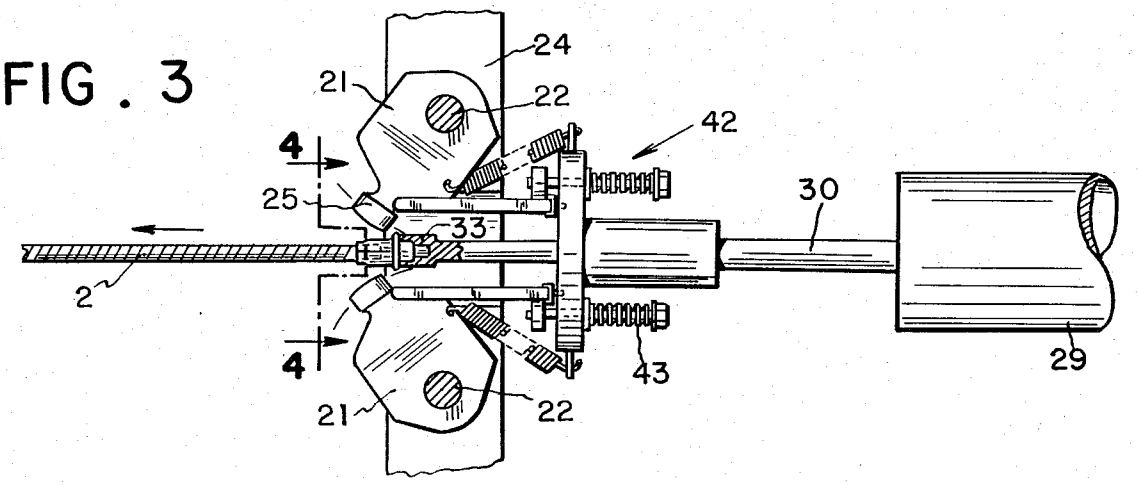
FIG. 3 is a view similar to FIG. 2 illustrating the fitting after being swaged onto the core and at the exit side of the swaging station.

There may be a tendency in some instances for the device shown in FIGS. 2 and 3 to cause the fitting to be pulled away from the cavity member 33 which can thus result in concentricity problems arising in the swaged fitting. This occurs because of the effective change in radius of the swaging tool between the point on the fitting that the forming faces 25 initially contact the outer surfaces of the fitting at the entry side of the swaging station and the point in the swaging station where the forming faces fully swage the fitting and the tools are in the directly opposed vertical or knuckle-through position. The effective change in radius causes a difference in the peripheral speed in the longitudinal direction of the forming faces and speed in the same direction of the fitting moved by the pushing means such that the fitting is pulled out of the cavity member.

Figure 6:
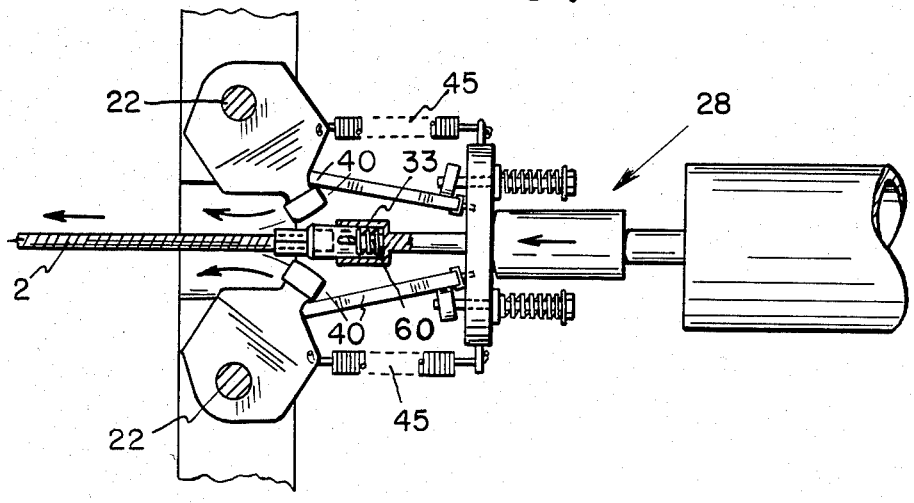
FIG. 6 is a view similar to FIG. 2 illustrating a further form of a swaging device constructed according to the invention.

In order to compensate for this difference in speed, a yieldable drive connection may be made either between the cavity member and pusher means or between the pusher fingers and pusher means. Referring to FIG. 6, where like parts have like identifying numerals, a further embodiment of the invention is shown where a drive connection comprising a compression spring is operatively inserted between the fitting 1 and cavity member 33. The pusher fingers 40 remain in the same form as in the embodiment of FIGS. 2 and 3 to provide a positive drive between the pusher means and swaging tools. Any difference in relative speed at the swaging station between the forming faces and fitting is taken up by the spring 60.

Figure 7:
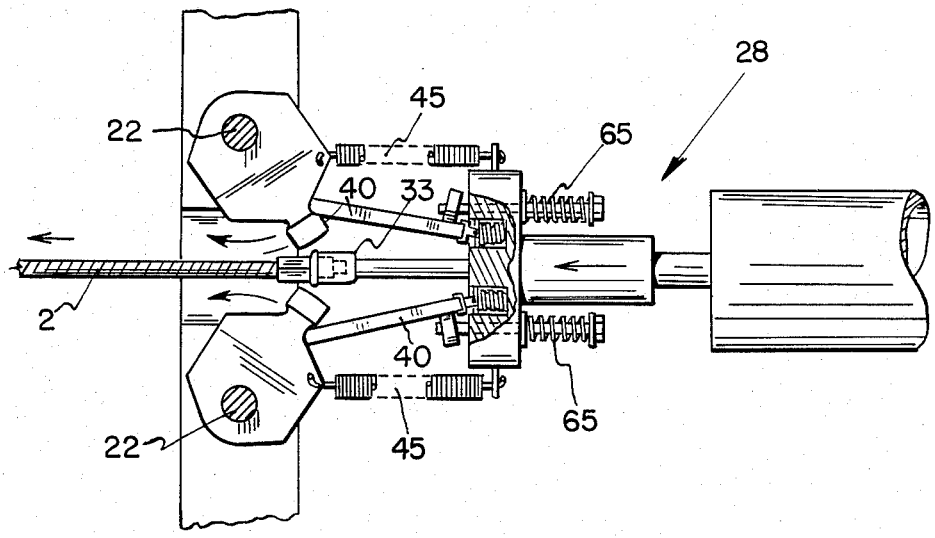
FIG. 7 is a view similar to FIG. 2 of a still further form of a swaging device constructed according to the invention.

Referring to FIG. 7, a further embodiment is shown wherein the difference in speed is taken up by having a yieldable drive connection in the form of a compression spring 65 operatively positioned between each of the pusher fingers and the pusher means. The drive connection between the cavity member and the pusher means remains in a direct form as in the embodiment of FIGS. 2 and 3.

The operation of the embodiments of the device of FIGS. 6 and 7 is the same as that for FIG. 2.

A swage device as described above swages the fitting by a rolling action rather than by inclined sliding engagement of a tool with a fitting or by impact of a tool with a fitting with the result that total energy required for the swaging process is less. Further a device according to the invention may be easily adapted for automatic feeding of the parts to the device and automatic operation of the device.

While the swaging device as described is used for swaging a loose sleeve-like fitting onto a core, the device also can be used for forming ends of rods, cables, strands, flexible shafts and other articles.

I claim:

1. A device for swaging an article having at least two opposed coplanar swaging tools forming a swaging station and where each tool is mounted for rotation about a fixed axis, characterized in having pusher means including a piston movable in a hydraulic cylinder for moving said article towards said swaging station such that said article initially contacts said swaging tools at an entry side of said swaging station and such that continued movement of said pusher means forces said article completely through said swaging station whereby each said tool will be rotated about its fixed axis to form said article and whereby said article will be ejected from an exit side of said swaging station, and return means for rotating said swaging tools to a point where they may again be engaged by an article, said return means including a return tension spring operatively positioned between each said swaging tool and said piston whereby the return tension springs will urge said swaging tools in a direction towards the entry side of said swaging station.

2. A device for swaging an article having at least two opposed coplanar swaging tools forming a swaging station and where each tool is mounted for rotation about a fixed axis, characterized in having pusher means including a piston movable in a hydraulic cylinder for moving said article towards said swaging station such that said article initially contacts said swaging tools at an entry side of said swaging station and such that continued movement of said pusher means forces said article completely through said swaging station whereby each said tool will be rotated about its fixed axis to form said article and whereby said article will be ejected from an exit side of said swaging station, return means for rotating said swaging tools to a point where they may again be engaged by an article, a cavity member operatively connected to said piston adapted to surround and engage an article, a pusher finger operatively positioned between each swaging tool and said piston, and a retainer spring operatively positioned between said finger and said piston for holding said finger into intimate contact with a portion of a swaging tool.

3. A device according to claim 2 further characterized in having a compression spring operatively positioned between said cavity member and piston to provide a yieldable drive connection between said piston and said article and wherein each finger is longitudinally fixed with respect to said piston to provide a positive drive connection between said piston and each said swaging tool.

4. A device according to claim 2 further characterized in having a compression spring operatively positioned between each finger and said piston to provide a yieldable drive connection between each said swaging tool and said piston and wherein said cavity member is fixed relative to said piston to provide a positive drive connection between said article and said piston.

* * * * *